US007231159B2

(12) United States Patent
Combs et al.

(10) Patent No.: US 7,231,159 B2
(45) Date of Patent: Jun. 12, 2007

(54) ARTICULATING USER INTERFACE PANEL

(75) Inventors: David M. Combs, Pflugerville, TX (US); Michael Ellis Smith, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 80 days.

(21) Appl. No.: 11/152,127

(22) Filed: Jun. 14, 2005

(65) Prior Publication Data

US 2006/0280516 A1 Dec. 14, 2006

(51) Int. Cl.
*G03G 15/00* (2006.01)

(52) U.S. Cl. ..... 399/81; 399/107

(58) Field of Classification Search ..... 347/5, 347/108, 152, 170, 222, 263; 399/81, 107; 108/99, 105, 115, 116, 50.01, 179; 312/21, 312/208.1, 27, 223.1, 30, 223.2, 242; 248/27.1
See application file for complete search history.

(56) References Cited

U.S. PATENT DOCUMENTS 4,450,454 A * 5/1984 Koto ..... 347/108
4,852,500 A 8/1989 Ryburg et al. ..... 108/105
4,973,175 A * 11/1990 Koike et al. ..... 312/223.2 X
4,996,561 A * 2/1991 Yoshimura et al. ..... 399/107
5,041,818 A * 8/1991 Liu ..... 312/223.2 X
5,082,336 A * 1/1992 Munch et al. ..... 312/242 X
5,555,157 A * 9/1996 Moller et al. ..... 312/223.2 X
5,729,430 A * 3/1998 Johnson ..... 312/223.2 X
5,831,818 A * 11/1998 Dat ..... 312/223.2 X
5,844,813 A * 12/1998 Tateyama ..... 347/5 X
5,926,364 A * 7/1999 Karidis ..... 312/223.2 X
6,324,362 B1 * 11/2001 Yokoyama et al. ..... 399/107
6,532,349 B1 * 3/2003 Todome ..... 399/81
6,665,173 B2 * 12/2003 Brandenberg et al. ..... 312/223.1 X
6,671,170 B2 * 12/2003 Webb et al. ..... 312/223.1 X
6,686,974 B2 * 2/2004 Goto et al. ..... 312/223.2 X
6,755,491 B2 * 6/2004 McElheney ..... 312/242
6,766,126 B2 * 7/2004 Hsu et al. ..... 399/81
6,913,332 B1 * 7/2005 Besterfield et al. .. 108/50.01 X
7,029,079 B2 * 4/2006 Holt ..... 108/50.01 X

* cited by examiner

*Primary Examiner*—Sandra L Brase
(74) *Attorney, Agent, or Firm*—Hamilton & Terrile, LLP; Stephen A. Terrile

(57) ABSTRACT

A printer includes an articulating user interface panel. The articulating user interface panel moves between a closed position and an open position.

10 Claims, 4 Drawing Sheets

ARTICULATING USER INTERFACE PANEL

BACKGROUND OF THE INVENTION

1. Field of the Invention

The present invention relates to the field of printers and the user interface panel of printers.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems. One example of an information handing system is a printer.

Known printers often provide a user interface panel via which a user can access and control the functions of the printer. There are a plurality of issues relating to the printer user interface panel. For example, known user interface panels often have an intimidating cluttered interface that is not always needed to use the printer (most printers also include software for controlling the printer via an information handling system coupled to the printer). Empirical user in-home studies have indicated that users often feel that their printers look cluttered and intimidating with all of the buttons and display present. Also, users with children indicated that the children often try to play with the interface. To avoid this, the users would locate the printer out of reach of the children.

Additionally, known user interface panels often protrude from the printer body, thus increasing the shipping cost of the printer.

SUMMARY OF THE INVENTION

In accordance with the present invention, a printer which includes an articulating user interface panel is disclosed. The articulating user interface panel addresses the issues relating to printer user interface panels by presenting an uncluttered interface unless the user desires access to the user interface panel and by reducing the form factor of the printer for shipping.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Figure 1:
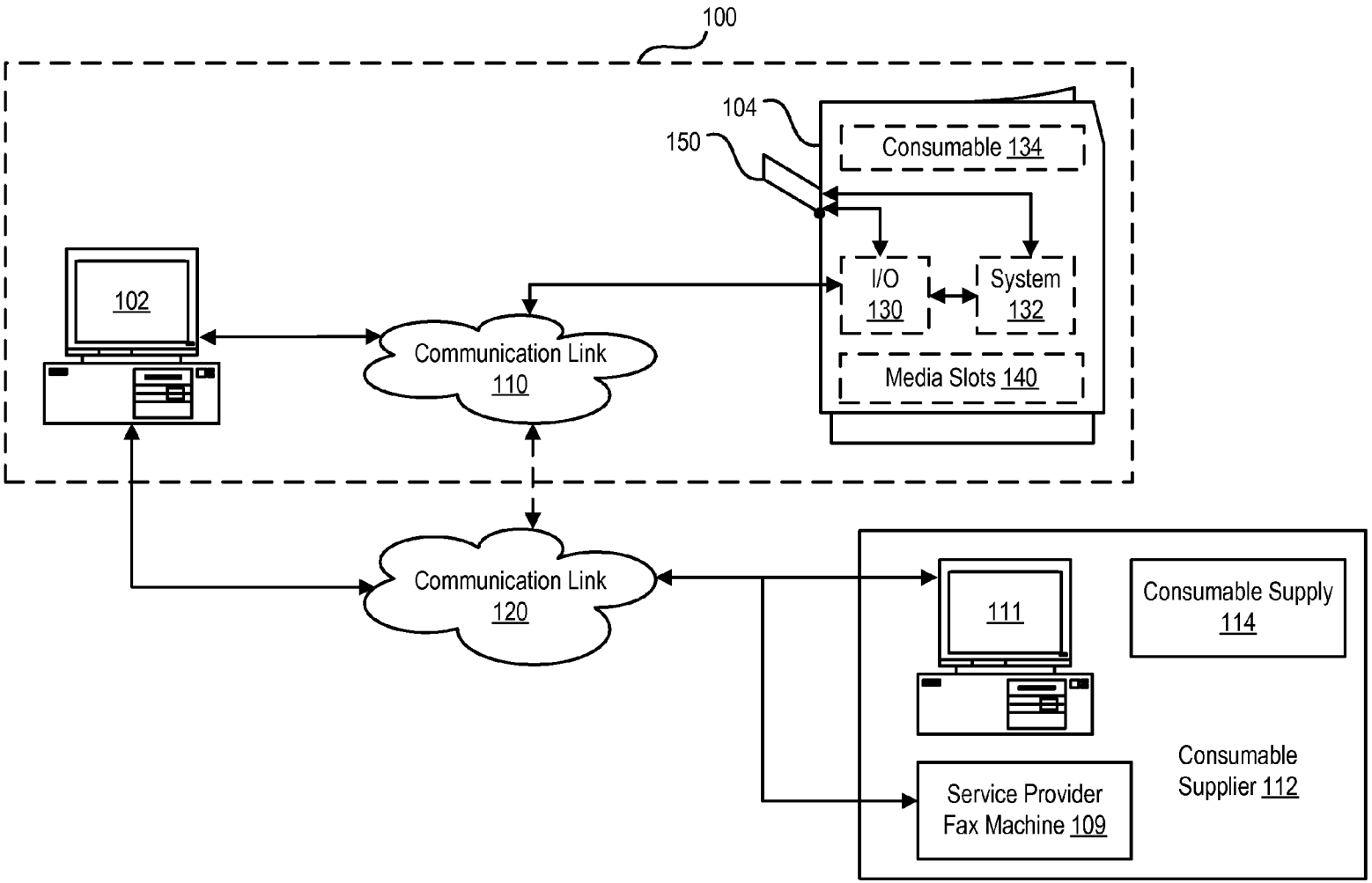
FIG. 1 shows a block diagram of an environment in which a printer having an articulating user interface panel is used.

Referring to FIG. 1, a block diagram of an environment in which a hybrid laser and inkjet printer is used is shown. The environment includes an information handling system 102 (such as a computer system or a camera) and a printer 104, coupled via a communication link 110. The communication link 110 might be a printer cable, a telephone cable, a network connection or any other link which information is communicated with the printer 104. In one embodiment, the printer 104 is included within a multifunction device such as a combination printer fax machine. Other functions may also be included within the multifunction device such as a scan function and a copy function. Also, in one embodiment, the environment does not include a computer system 102.

The printer 104 is coupled to a second communication link 120. Thus, communication may occur between the printer 104 and anything coupled to the second communication link 120 such as a services provider fax machine 109. Additionally, the computer system 102 is also connected to another computer system (e.g., a services provider computer system) 111 via a second communication link 120. The second communication link 120 may be a telephone system or some other type of network, such as the Internet. In one embodiment, the fax machine 109 and the computer system 111 are owned and operated by a consumable supplier 112. In this example, the service provider 112 may provide service for the printer 104.

The printer 104 includes an input output (I/O) port 130, a control system 132 and at least two types of consumables 134. The I/O port 130 facilitates communications between the printer 104 and other devices connected to the communications link 110. The control system 132 provides the printer 104 with certain control functionality. The control system 132 includes a processor and memory coupled to the processor. The printer 104 may also include one or more media slots 140.

The consumables 134 represent any component in the printer 104 that is subject to depletion through use of the printer 104. For example, the consumable 134 may be a toner cartridge or an inkjet cartridge, etc. The service provider maintains a supply 114 of replacement consumables 134.

The printer 104 also includes an articulating user interface panel 150 which is coupled to the control system 132. The articulating user interface panel 150 may be in an open position to allow a user to control the printer directly or may in a closed position, in which case the user would control the printer 104 via the information handling system 102. The articulating user interface panel 150 may also be in the closed position when the printer is shipped from a printer supplier to the customer.

In operation, the computer system 102 generates a document in an electronic form and transmits the document (in the form of a print job) to the printer 104. The printer 104 receives the job via the I/O port 130 and prints the document. Additionally, when the printer 104 is part of a multifunction device, the printer 104 may receive and print information from the communication link 120 or from a scanned image when operating as a copier. Additionally, the printer 104 may receive and print information from any of its media slots 140.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 2:
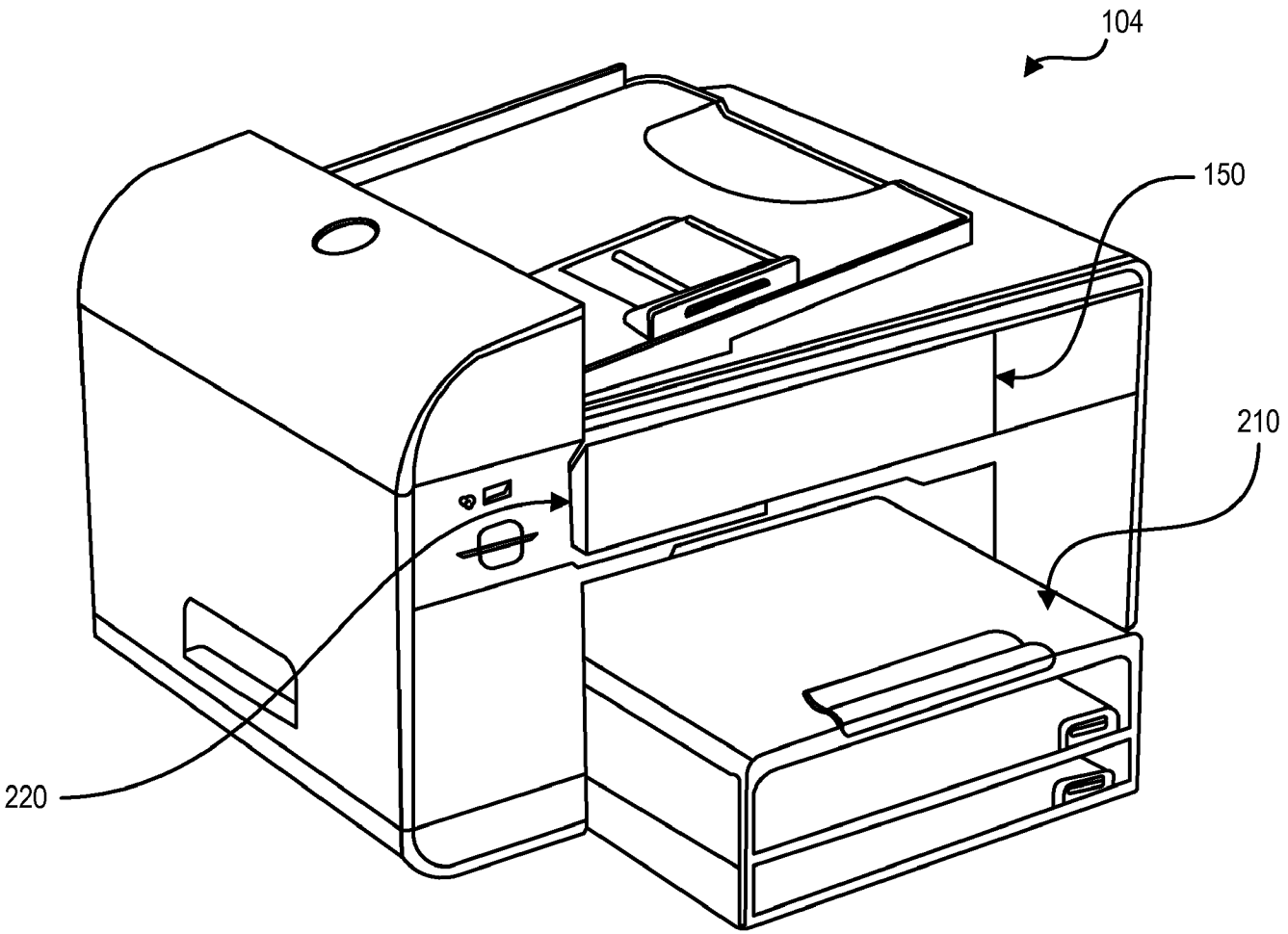
FIG. 2 shows a perspective view of a printer with the articulating user interface panel in the closed position.

Referring to FIG. 2, a perspective view of a printer 104 with the articulating user interface panel 150 in the closed position is shown. When the printer 104 is fully deployed and the articulating user interface panel 150 is in the closed position, the printer 104 provides a clean non-intimidating aesthetic while securing the user interface panel from unintentional use.

When the user interface panel 150 is in the closed position, an edge 220 of the user interface panel 150 is exposed and accessible so that the user interface panel can be articulated from the closed position to the open position. The remainder of the user interface panel 150 is flush with the printer housing to maintain the clean aesthetic when the user interface panel 150 is closed.

Figure 3:
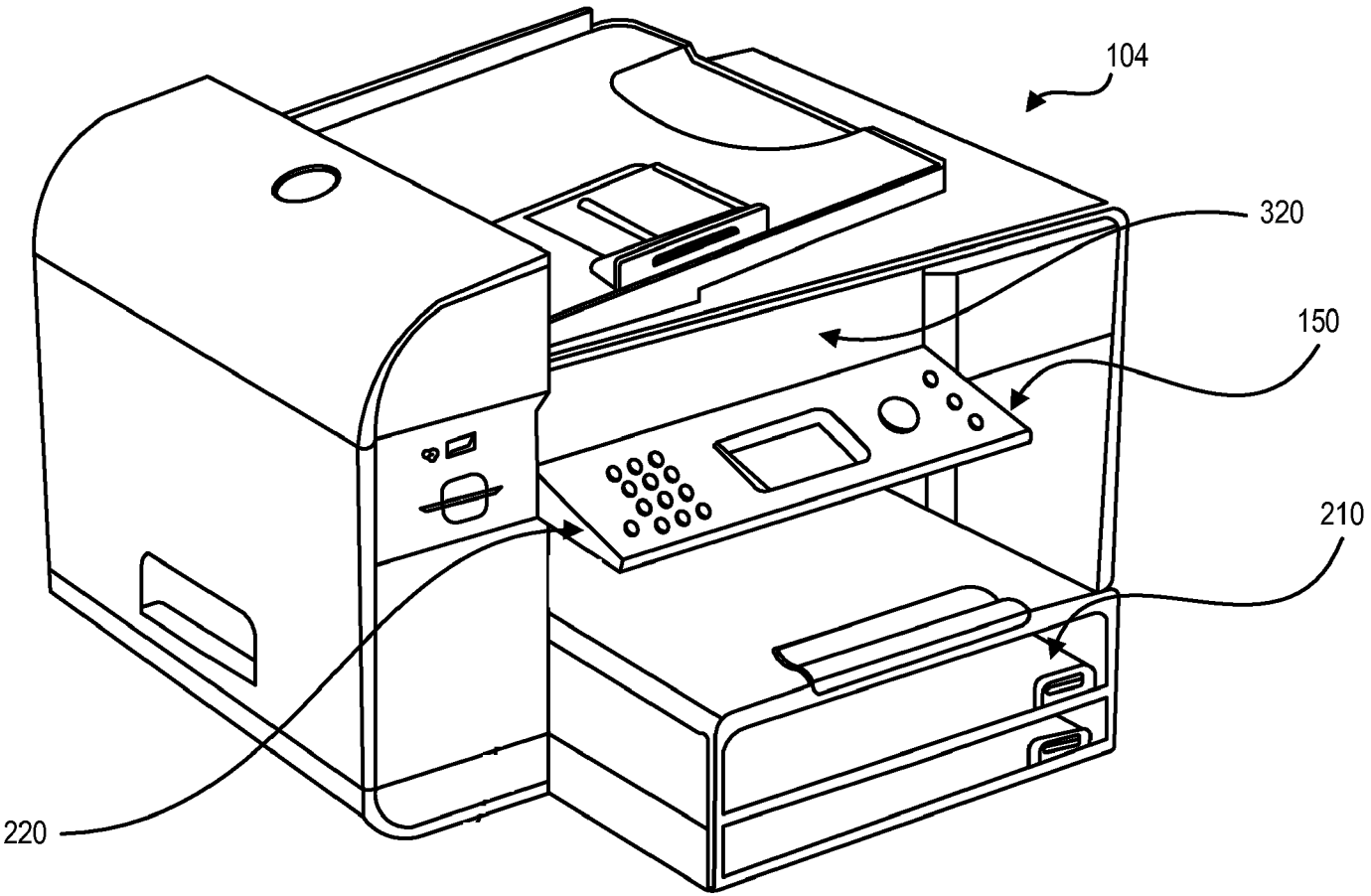
FIG. 3 shows a perspective view of a printer with the articulating user interface panel in the open position.

Referring to FIG. 3, a perspective view of the printer 104 with the articulating user interface panel 150 in the open position is shown. To open the articulating user interface panel 150 from the closed position to the open position, the user simply pulls on the exposed edge 220 of the user interface panel 150 which causes the user interface panel to pivot from the closed position to the open position.

When the user interface panel 150 is in the open position, a portion of the bottom of the user interface panel 150 (i.e., the face of the user interface panel 150 when the user interface panel is in the closed position) rests on the ledge of the recess 320 in which the panel resides when in the closed position. By so resting, the ledge provides support to provide support for the user interface panel 150 when the panel is in the open position.

By providing the user interface panel 150 on the front of the printer 104 (i.e., on the side of the printer that is designed to face the user), the user interface panel 150 is easily accessible by the user when the panel is in the open position.

Figure 4:
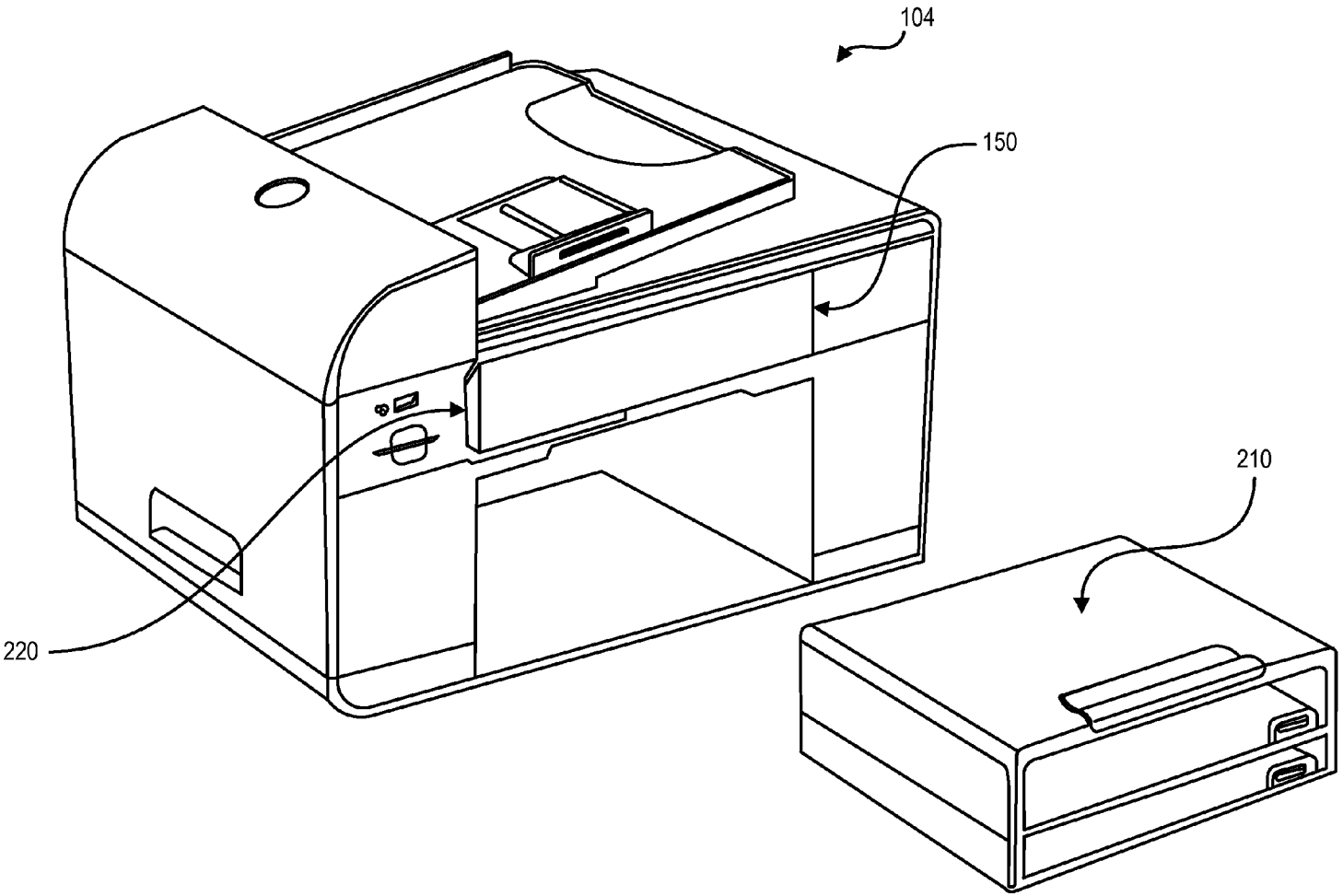
FIG. 4 shows a perspective view of a printer with the articulating user interface in a closed position and paper trays removed.

Referring to FIG. 4, a perspective view of the printer 104 with the articulating user interface panel in the closed position and the paper trays removed is shown. When the user interface panel 150 is in the closed position and the paper tray or trays 210 are removed, the printer 104 provides a cube like form factor that is more efficient for shipping the printer 104 from a printer supplier to a customer. This cube like form factor allows the user of a smaller box and less packing material than would be needed for a printer having a fixed user interface panel.

Additionally, when the printer 104 is first removed from the box by the user, the printer provides a clean, uncluttered presentation because the user panel is closed.

The present invention is well adapted to attain the advantages mentioned as well as others inherent therein. While the present invention has been depicted, described, and is defined by reference to particular embodiments of the invention, such references do not imply a limitation on the invention, and no such limitation is to be inferred. The invention is capable of considerable modification, alteration, and equivalents in form and function, as will occur to those ordinarily skilled in the pertinent arts. The depicted and described embodiments are examples only, and are not exhaustive of the scope of the invention.

For example, the above-discussed embodiments include software modules that perform certain tasks. The software modules discussed herein may include script, batch, or other executable files. The software modules may be stored on a machine-readable or computer-readable storage medium such as a disk drive. Storage devices used for storing software modules in accordance with an embodiment of the invention may be magnetic floppy disks, hard disks, or optical discs such as CD-ROMs or CD-Rs, for example. A storage device used for storing firmware or hardware modules in accordance with an embodiment of the invention may also include a semiconductor-based memory, which may be permanently, removably or remotely coupled to a microprocessor/memory system. Thus, the modules may be stored within a computer system memory to configure the computer system to perform the functions of the module. Other new and various types of computer-readable storage media may be used to store the modules discussed herein. Additionally, those skilled in the art will recognize that the separation of functionality into modules is for illustrative purposes. Alternative embodiments may merge the functionality of multiple modules into a single module or may impose an alternate decomposition of functionality of modules. For example, a software module for calling sub-modules may be decomposed so that each sub-module performs its function and passes control directly to another sub-module.

Also for example, it will be appreciated that the location of the articulating user interface panel may be modified while still addressing the issues with known user interface panels.

Also for example, the articulating user interface panel 104 can be modified to include multiple hard stores so that the panel can be viewed and used at various angles to adapt to varying deployment scenarios. Thus the panel can be adapted to optimize viewing angles for different height and lighting situations.

Also for example, the articulating user interface panel 104 can be modified so that the user interface panel 150 can be opened to either a flat presentation (head on) for when the printer is located substantially at the eye level of the user or a folded out presentation for when the printer is located somewhat below the eye level of the user.

Consequently, the invention is intended to be limited only by the spirit and scope of the appended claims, giving full cognizance to equivalents in all respects.

What is claimed is:

1. A printer comprising:

a printer housing, the printer housing defining a recess; and a user interface panel coupled to the printer housing, the interface panel including controls for controlling the printer, the user interface panel pivoting between a closed position and an open position such that when the user interface panel is in the closed position, the controls for controlling the printer are not visible and when the user interface panel is in the open position, the controls for controlling the printer are accessible, the user interface panel being positioned within the recess when the user interface panel is in the closed position, the user interface panel being substantially flush with the printer housing when the user interface panel is positioned within the recess, the user interface panel including an exposed edge when in the closed position, the exposed edge allowing a user to pivot the user interface panel between the closed position and the open position.

2. The printer of claim 1 wherein:

the user interface panel is located on the front of the printer housing.

3. The printer of claim 1 wherein:

the recess includes a ledge; and, the user interface panel rests on the ledge when the user interface panel is in the open position.

4. The printer of claim 1 further comprising:

a control system, the control system controlling the printer, the user interface panel being coupled to the control system.

5. An information handling system comprising:

a control system, the control system including a processor;

a housing, the housing defining a recess; and a user interface panel coupled to the housing and the control system, the interface panel including controls for controlling the information handling system, the user interface panel pivoting between a closed position and an open position such that when the user interface panel is in the closed position, the controls for controlling the information handling system are not visible and when the user interface panel is in the open position, the controls for controlling the information handling system are accessible, the user interface panel being positioned within the recess when the user interface panel is in the closed position, the user interface panel being substantially flush with the housing when the user interface panel is positioned within the recess, the user interface panel including an exposed edge when in the closed position, the exposed edge allowing a user to pivot the user interface panel between the closed position and the open position.

6. The information handling system of claim 5 wherein:

the user interface panel is located on the front of the housing.

7. The information handling system of claim 5 wherein:

the recess includes a ledge; and, the user interface panel rests on the ledge when the user interface panel is in the open position.

8. An apparatus for printing documents comprising:

a control system, the control system including a processor;

a housing, the housing defining a recess; and a user interface panel coupled to the housing and the control system, the interface panel including controls for controlling printing documents, the user interface panel pivoting between a closed position and an open position such that when the user interface panel is in the closed position, the controls are not visible and when the user interface panel is in the open position, the controls are accessible, the user interface panel being positioned within the recess when the user interface panel is in the closed position, the user interface panel being substantially flush with the housing when the user interface panel is positioned within the recess, the user interface panel including an exposed edge when in the closed position, the exposed edge allowing a user to pivot the user interface panel between the closed position and the open position.

9. The apparatus of claim 8 wherein:

the user interface panel is located on the front of the housing.

10. The apparatus of claim 8 wherein:

the recess includes a ledge; and, the user interface panel rests on the ledge when the user interface panel is in the open position.

* * * * *